US009163406B1

(12) United States Patent
Ealer, Sr.

(10) Patent No.: US 9,163,406 B1
(45) Date of Patent: Oct. 20, 2015

(54) GUTTER COVER WITH FRONT DRAIN TROUGH

(71) Applicant: James E. Ealer, Sr., St. Clair, MO (US)

(72) Inventor: James E. Ealer, Sr., St. Clair, MO (US)

( * ) Notice: Subject to any disclaimer, the term of this patent is extended or adjusted under 35 U.S.C. 154(b) by 0 days.

(21) Appl. No.: 14/512,497

(22) Filed: Oct. 13, 2014

(51) Int. Cl.
*E04D 13/064* (2006.01)
*E04D 13/076* (2006.01)
*E04D 13/00* (2006.01)

(52) U.S. Cl.
CPC ..... *E04D 13/076* (2013.01); *E04D 13/00* (2013.01); *E04D 13/064* (2013.01)

(58) Field of Classification Search
CPC . E04D 13/076; E04D 13/064; E04D 13/0762; E04D 13/0725; E04D 13/04; E04D 13/068; E04D 13/0685; E04D 13/072
USPC ..... 52/11, 12, 13, 14, 15, 16; D23/261, D23/267; 4/510; 248/48.1, 48.2
See application file for complete search history.

(56) References Cited

U.S. PATENT DOCUMENTS

| | | | | |
|---|---|---|---|---|
| 2,672,832 | A | 3/1954 | Goetz | |
| 4,907,381 | A | 3/1990 | Ealer | |
| 5,181,350 | A * | 1/1993 | Meckstroth | 52/12 |
| 5,271,192 | A | 12/1993 | Nothum, Sr. et al. | |
| 5,375,379 | A * | 12/1994 | Meckstroth | 52/12 |
| 5,459,965 | A | 10/1995 | Meckstroth | |
| 5,660,001 | A * | 8/1997 | Albracht | 52/12 |
| 6,098,344 | A * | 8/2000 | Albracht | 52/12 |
| 6,412,228 | B1 * | 7/2002 | Meckstroth | 52/12 |
| 6,941,707 | B2 * | 9/2005 | Sigmund | 52/95 |
| D523,538 | S * | 6/2006 | Brochu | D23/267 |
| 7,627,991 | B1 | 12/2009 | Feldhaus | |
| D623,279 | S * | 9/2010 | Joly et al. | D23/267 |
| 7,891,142 | B1 | 2/2011 | Ealer, Sr. | |
| D672,016 | S * | 12/2012 | Walker | D23/267 |
| 2003/0046876 | A1 * | 3/2003 | Higginbotham | 52/11 |
| 2005/0034377 | A1 * | 2/2005 | Willert | 52/11 |
| 2006/0101722 | A1 * | 5/2006 | Ealer, Sr. | 52/12 |
| 2006/0107603 | A1 * | 5/2006 | Brownridge | 52/11 |
| 2006/0196124 | A1 * | 9/2006 | Bachman | 52/12 |
| 2007/0094939 | A1 * | 5/2007 | Bachman | 52/11 |
| 2007/0169423 | A1 * | 7/2007 | Brochu | 52/12 |
| 2007/0199249 | A1 * | 8/2007 | Beck et al. | 52/12 |
| 2007/0214730 | A1 * | 9/2007 | Cota | 52/12 |
| 2008/0010906 | A1 * | 1/2008 | Brochu | 52/12 |
| 2008/0047206 | A1 * | 2/2008 | Gramling | 52/12 |
| 2009/0013612 | A1 * | 1/2009 | Brochu | 52/12 |
| 2009/0108144 | A1 * | 4/2009 | Brochu | 248/48.1 |
| 2010/0071273 | A1 * | 3/2010 | Joly et al. | 52/12 |
| 2011/0126477 | A1 * | 6/2011 | Hurn | 52/12 |
| 2011/0138698 | A1 * | 6/2011 | Neumann | 52/12 |
| 2011/0185641 | A1 * | 8/2011 | Snell | 52/12 |
| 2011/0265391 | A1 * | 11/2011 | Robins | 52/12 |
| 2012/0151849 | A1 * | 6/2012 | Brochu | 52/12 |
| 2012/0186163 | A1 * | 7/2012 | Walker | 52/12 |
| 2012/0192502 | A1 * | 8/2012 | Glander | 52/12 |

(Continued)

*Primary Examiner* — Elizabeth A Plummer
*Assistant Examiner* — Kyle Walraed-Sullivan
(74) *Attorney, Agent, or Firm* — Sennier Powers LLP

(57) ABSTRACT

A gutter cover for covering a gutter supported by gutter hangers is disclosed. The gutter cover has a front cover portion comprising a surface tension curve curving downward and rearward from a central cover portion for directing water in a downward and rearward direction, a drain trough extending lengthwise of the gutter cover below the surface tension curve for collecting water directed by the surface tension curve, and a recess forward of the drain trough for receiving the gutter flange when the gutter cover is in said installed position.

16 Claims, 9 Drawing Sheets

(56) References Cited

U.S. PATENT DOCUMENTS

2012/0222366 A1* 9/2012 Steinberg et al. ..... 52/12
2013/0067830 A1* 3/2013 Sharkey ..... 52/12
2013/0091780 A1* 4/2013 Robins ..... 52/12
2013/0160377 A1* 6/2013 Sager ..... 52/12
2013/0160378 A1* 6/2013 Higginbotham ..... 52/12
2014/0215929 A1* 8/2014 Lenney ..... 52/12

* cited by examiner

GUTTER COVER WITH FRONT DRAIN TROUGH

BACKGROUND OF THE INVENTION

The present invention relates generally to rain gutters and more particularly to a gutter cover for preventing debris from falling into such gutters.

Since leaves and other debris frequently clog up rain gutters, some kind of guard or cover which prevents debris from falling into the gutter is desirable. Ideally, a gutter cover directs water into the gutter, prevents debris from entering the gutter, does not itself become clogged with debris, and is securely attached to the gutter. The ideal gutter screen is easy to install and requires little if any maintenance after installation.

Reference may be made to U.S. Pat. Nos. 4,907,381, 5,893,240, 6,151,837, 7,650,720, 7,765,742, 7,891,142, 8,146,218, D638,920, and D683,827 disclosing gutter screens incorporating my inventions.

SUMMARY OF THE INVENTION

In general, a first embodiment of this invention is directed to an elongate gutter cover for covering a gutter supported by a gutter hanger. The gutter has front, back and bottom walls and a flange projecting rearward from the front wall and spaced above the bottom wall of the gutter. The gutter cover comprises a central cover portion configured to overlie the gutter when the gutter cover is in an installed position on the gutter, and a front cover portion. The front cover portion comprises a surface tension curve curving downward and rearward from the central cover portion for directing water in a downward and rearward direction, and a drain trough extending lengthwise of the gutter cover below the surface tension curve for collecting water directed by the surface tension curve. One or more drain openings are provided in the drain trough for draining water into the gutter. The front cover portion 62 also includes a recess forward of the drain trough extending lengthwise of the gutter cover for receiving the gutter flange when the gutter cover is in its installed position. The gutter cover further comprises a rear cover portion configured to contact a rear portion of the gutter hanger. The resilient flexible material of the gutter cover resiliently flexes during installation of the gutter cover such that when the gutter cover is installed, the front cover portion is resiliently urged against the gutter flange and the rear cover portion is resiliently urged against the rear portion of the gutter hanger.

In another embodiment, this invention is directed to a gutter system comprising a gutter, a gutter hanger, and a gutter cover as described in the preceding paragraph Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
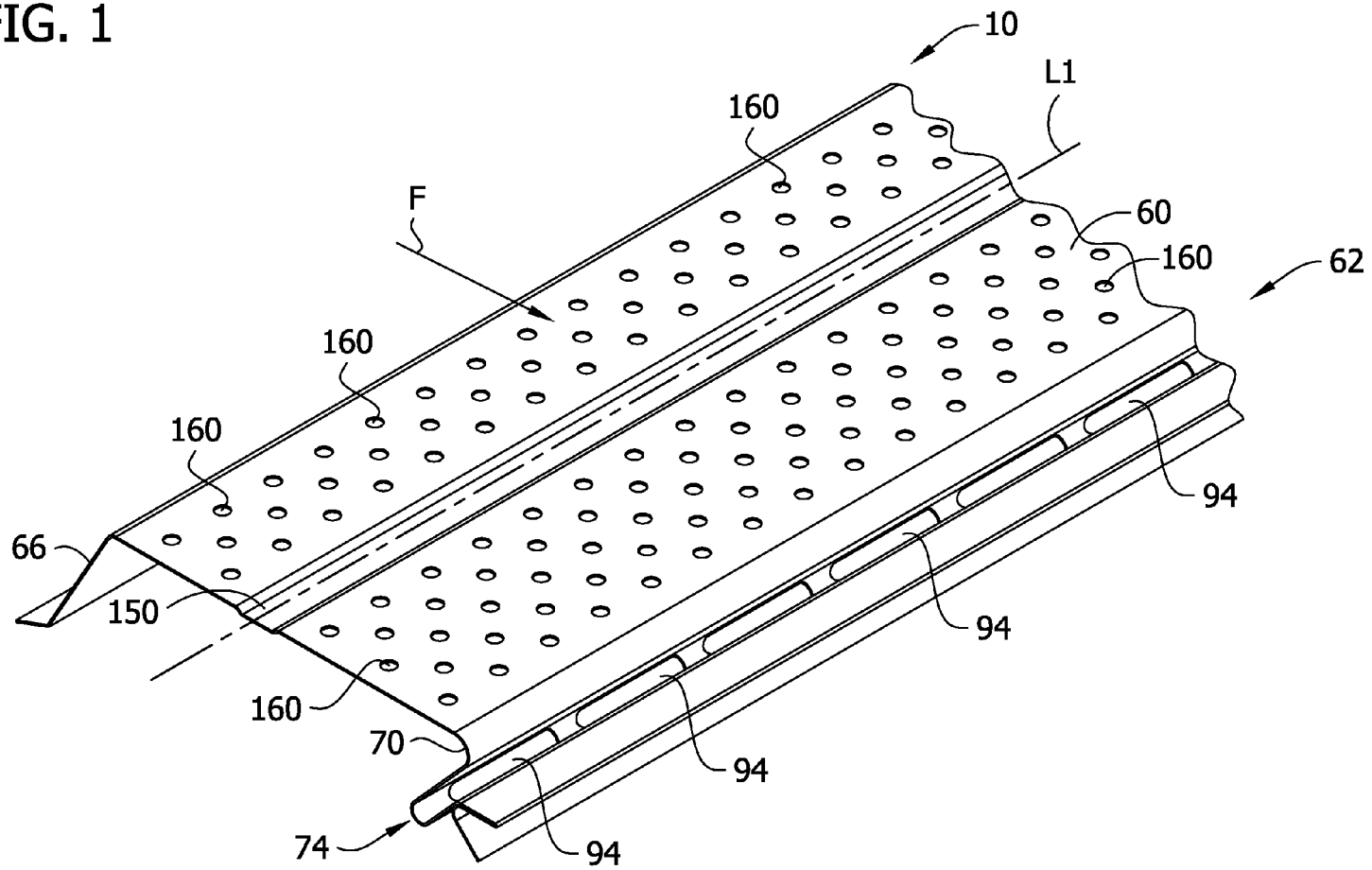
FIG. 1 is a perspective view of a first embodiment of a gutter cover of this invention.
Figure 2:
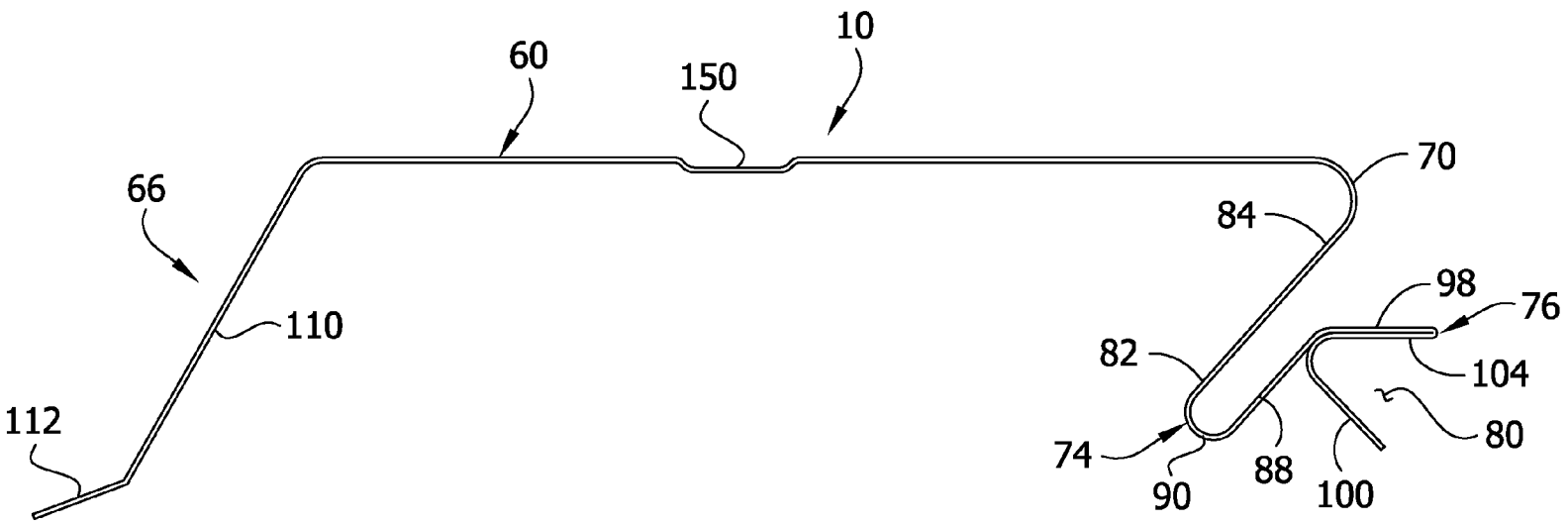
FIG. 2 is a left end elevation of the gutter cover of FIG. 1.
Figure 3:
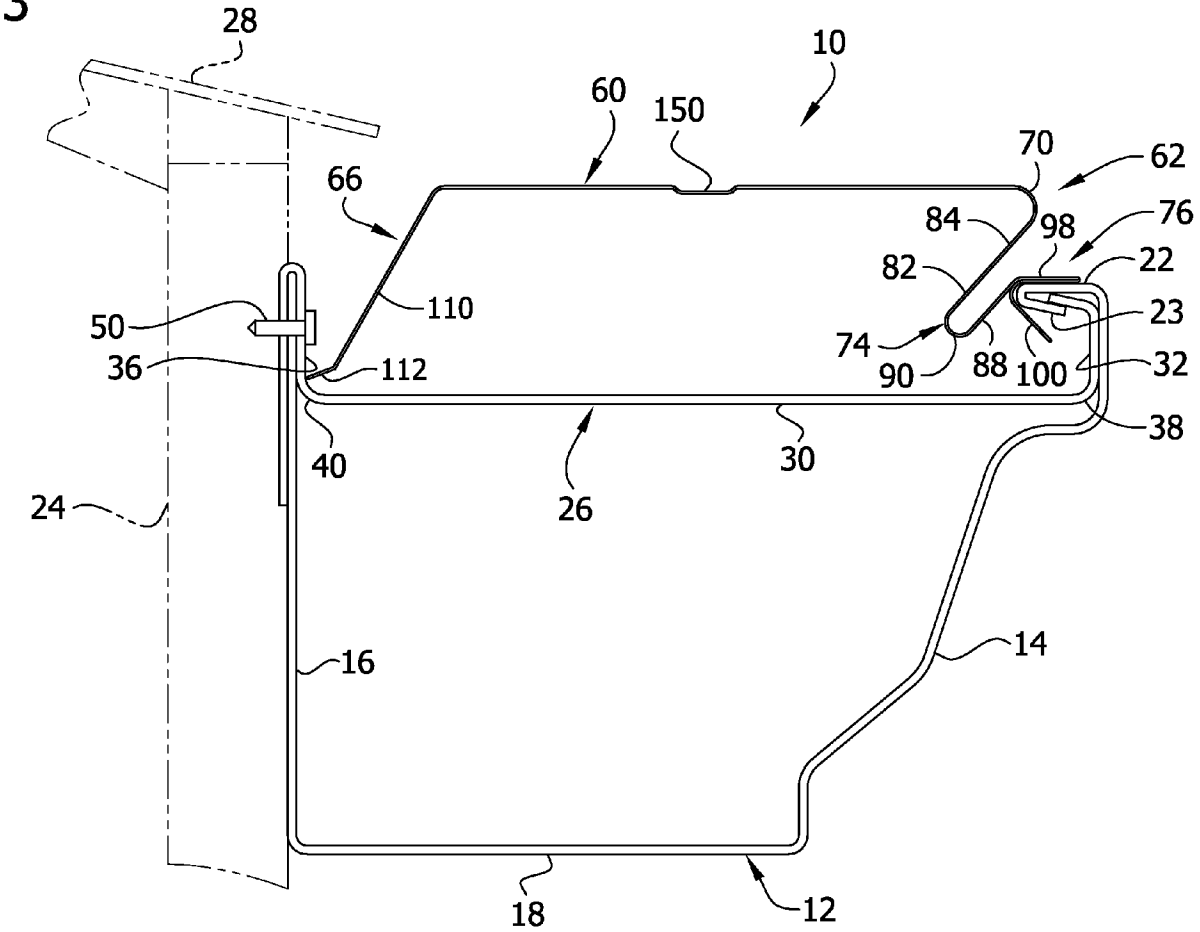
FIG. 3 is a transverse cross-sectional view of the gutter cover of FIG. 1 as installed on a gutter.

Referring now to the drawings, FIGS. 1-3 illustrate a first embodiment of a gutter cover of my invention, generally designated 10. The gutter cover 10 is shown in FIG. 3 in a properly installed position on a rain gutter 12 to prevent debris from falling into the gutter while allowing the passage of water into the gutter. As shown in FIG. 3, the gutter 12 has a front wall 14, a back wall 16 and a bottom wall 18, all of which combine to form a channel for drainage of rainwater. A conventional flange 22 having a lower portion or hem 23 projects rearward (i.e., toward the building to which the gutter is attached) from the upper edge of the front wall 14. The gutter 12 is suitably attached to a wall 24 of the building by gutter hangers 26 (only one shown in FIG. 3) to collect rainwater flowing off a downwardly sloping roof 28 of the building.

Each gutter hanger 26 has a generally horizontal central hanger portion 30, an upright front hanger portion 32 extending up from the central hanger portion to a location below the gutter flange 22, and an upright rear hanger portion 36 extending up from the central hanger portion generally at the back wall 16 of the gutter. The front hanger portion 32 is connected to the central hanger portion 30 by a front hanger bend 38, and the rear hanger portion 36 is connected to the central hanger portion by a rear hanger bend 40. The upper end of the front hanger portion 32 is bent to fit inside the gutter flange 22 to reinforce the front wall 14 of the gutter against outwardly directed forces, such as caused by someone pulling on the gutter while climbing onto the roof 28. The upper end of the rear hanger portion 36 is bent at 44 to hook over the back wall 16 of the gutter 12. The rear hanger portion 36 is secured to the wall 14 by a fastening device 50, such as a screw or nail, to secure the gutter hanger to the wall 24 adjacent the roof 28 of the building.

As illustrated in FIGS. 1 and 2, the gutter cover 10 comprises an elongate sheet of flexible resilient sheet material (e.g., solid sheet with or without perforations, wire mesh sheet, expanded metal sheet) made from metal, such as aluminum, or vinyl, or other plastic having a thickness in the exemplary range of 0.010-0.045 in. The cover 10 has a longitudinal axis L1 transverse to the direction of water flow F down the roof. In its installed position (FIG. 3), the cover 10 has a central cover portion generally designated 60 configured to overlie the gutter, a front cover portion generally designated 62 configured for contact with the gutter flange 22, and a rear cover portion generally designated 66 configured for contact with the rear portion of the gutter hanger at or adjacent the rear bend 40 of the gutter hanger. Desirably, the central, front, and rear cover portions 62, 66 of the gutter cover 10 are integrally formed as a single unitary member (i.e., in one piece).

Referring to FIGS. 1-3, the central cover portion 60 is substantially flat and lies in a generally horizontal plane when the gutter cover is installed on a gutter. However, other configurations are possible. By way of example but not limitation, the central cover portion may be non-planar, e.g., upwardly arched.

The front cover portion 62 comprises a surface tension curve 70 curving downward and rearward from the central cover portion for directing water in a downward and rearward direction, and a drain trough generally designated 74 extending lengthwise of the gutter cover below the surface tension curve for collecting water directed by the surface tension curve. By way of example but not limitation, the surface tension curve may be a concave curve having only one radius of curvature or a concave curve having more than one radius of curvature, as described in my U.S. Pat. No. 7,765,742 incorporated herein by reference. The front cover portion 62 also includes a channel formation generally designated 76 forward of the drain trough defining a recess 80 extending lengthwise of the gutter cover for receiving the gutter flange 22 when the gutter cover is in its installed position.

In the embodiment of FIGS. 1-3, the drain trough 74 comprises a back wall 82 connected by a straight wall segment 84 to the lower end of the surface tension curve 70, a front wall 88 spaced forward from the back wall and connected to the channel formation 76, and a bottom wall 90 which, in this embodiment, is generally U-shaped. Desirably, the bottom wall 90 is located rearward of the surface tension curve 70, and the surface tension curve is located directly over the channel formation 76. In the illustrated embodiment, the front end of the surface tension curve is positioned slightly forward of the back end of the channel formation. Other configurations are possible. The front and back walls 88, 82 of the drain trough 74 lie in trough wall planes sloping in upward and forward from the bottom wall 90 of the drain trough when the gutter cover is in its installed position. Each trough wall plane slopes at an angle relative to a plane defining the central cover portion of the gutter cover. By way of example but not limitation, this angle may be in the range of 30-90 degrees (e.g. about 45-50 degrees). The drain trough may have other configurations.

Referring to FIG. 1, one or more drain openings 94 are provided in the drain trough 74 for draining water into the gutter. In one embodiment, slots are provided having lengths aligned with the length of the trough and spaced at intervals along the bottom wall of the trough. By way of example but not limitation, the slots may have a width in the range of ¼ in to ⅜ in (e.g., about 5/16 in.), a length in the range of ¾ in to 2 in (e.g., about 1¼ in.), and adjacent slots may be separated by a distance in the range of ¼ in to 2 in (e.g., about ¾ in). The drain openings 94 may have other shapes (e.g., circular).

Referring to FIGS. 2 and 3, the channel formation 76 comprises an upper leg 98 extending forward from the drain trough 74 and adapted to overlie the gutter flange 22, and a lower leg 100 extending forward and downward relative to the upper leg to define the recess 80 for receiving the gutter flange 22 when the gutter cover is in said installed position. The upper leg 98 extends generally horizontally when the gutter cover is in its installed position, and the lower leg 100 extends at an acute angle relative to the upper leg 98 when the gutter cover is in its installed position. By way of example but not limitation, this angle may be in the range of 30-90 degrees (e.g., about 40-50 degrees). The upper and lower legs of the channel formation are integrally connected by a third leg 104 underlying the upper leg. The channel formation may have other configurations.

Desirably, the bottom wall 90 of the drain trough 74 is located below the upper leg 98 of the channel formation 76. As a result, when the gutter cover 10 is installed on a gutter, the bottom wall 90 of the trough is at an elevation below the gutter flange 22. This arrangement reduces the risk of water overflowing the gutter flange.

Figure 4:
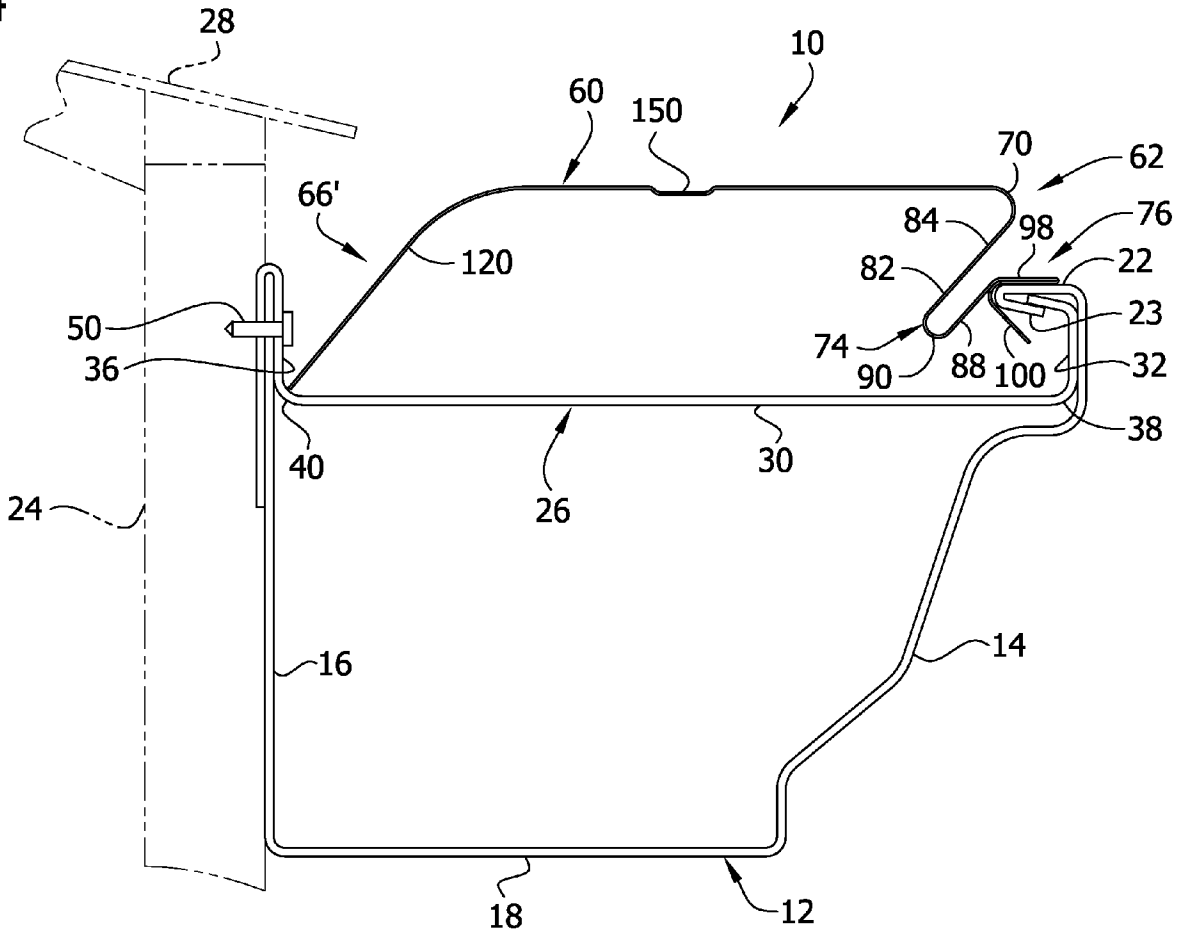
FIG. 4 is a view similar to FIG. 3 but showing the gutter cover with a rear cover portion having a different configuration.
Figure 5:
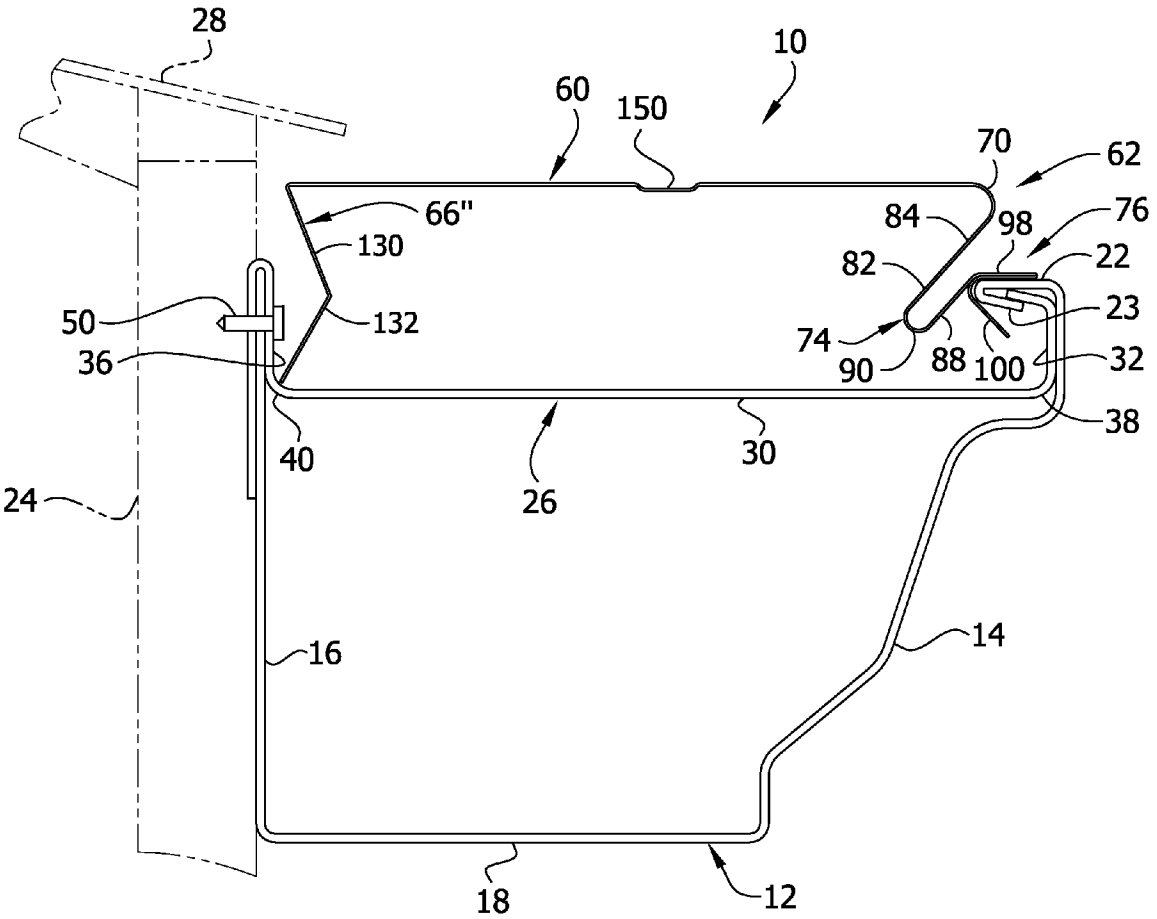
FIG. 5 is a view similar to FIG. 3 but showing the gutter cover with a rear cover portion having still another configuration.

The rear cover portion 66 of the gutter cover 10 comprises a straight leg 110 extending downward and rearward at an oblique angle (e.g., 90-160 degrees, and desirably about 120 degrees) from the substantially flat central cover portion 60. This profile keeps the rear cover portion 66 of the gutter in resilient engagement with the gutter hanger 26 when the gutter cover is installed on the gutter. In the embodiment of FIG. 3, the lower end of the leg is bent at an angle relative to the leg to form a foot 112 which contacts the rear portion 36 of the gutter hanger (at or near the rear bend 40) when the gutter cover is installed on the gutter. The rear cover portion of the gutter cover 10 may have other configurations without departing from the scope of this invention. By way of example, in FIG. 4 the rear cover portion (designated 66') comprises a curved leg 120 extending downward and rearward from the substantially flat central cover portion 60. The leg terminates in a lower end which contacts the rear portion 36 of the gutter hanger 26 (at or near the rear bend 40) when the gutter cover is installed on the gutter. In FIG. 5, the rear cover portion (designated 66") comprises an upper leg 130 extending downward and forward from the central cover portion 60 and a lower leg 132 extending downward and rearward from the upper leg. The lower leg 132 terminates in a lower end which contacts a rear portion 36 of the gutter hanger (at or near the rear bend 40) when the gutter cover is installed on the gutter. Other configurations are possible. By way of example but not limitation, the rear cover portion of the gutter cover 10 may have the multiple-bend configurations described in my U.S. Pat. Nos. 7,891,142, 7,650,720, 8,402,697, and D683, 827, all of which are incorporated herein by reference.

Desirably, the front cover portion 62, central cover portion 60, and rear cover portion 66, 66', 66" of the gutter cover 10 are integrally formed as one piece of a flexible resilient material. This material resiliently flexes during installation of the gutter cover such that when the gutter cover is installed, the channel formation 76 of the front cover portion 62 is resiliently urged against the gutter flange 22 and the rear cover portion 66, 66', 66" is resiliently urged against the rear portion 36 of the gutter hanger 26, as illustrated in FIGS. 3-5.

Referring to FIG. 1, it will be observed that drain holes 160 are provided in the central cover portion 60. These holes are of suitable size and shape. By way of example but not limitation, the drain holes may be round and have a diameter in the range of 1/16-½ in, e.g., about 3/16 in. The holes 160 are distributed substantially uniformly along one or more rows of holes, and desirably (but not necessarily) cover substantially the entire area of the central cover portion 60.

Desirably, the overall width W of the unstressed gutter cover 10 (see FIG. 1) will vary depending on the width of the gutter 12 on which the gutter cover is to be installed. In this regard, the gutter 12 may have a typical width of five, six, or seven inches, as measured from the back wall 16 of the gutter to the front wall 14 of the gutter at the front of the flange 22. Desirably, the gutter cover 10 may be sized to fit gutters of different widths simply by changing the width dimension of the central cover portion 60. By way of example but not limitation, the central cover portion may have a width of about 4 in. for a 5 in.-wide gutter, about 5 in. for a 6 in.-wide gutter, and about 6 in. for a 7 in.-wide gutter. Desirably, the profiles of the front and rear cover portions 62, 66 (66', 66") remain the same regardless of the width of the central cover portion 60.

The gutter cover 10 described above is easy to install by placing the lower end of the rear cover portion 66, 66', 66" on the gutter flange 22 in contact with the rear bend 40 of the gutter hanger 26 below the head of the fastener 50. The installer then pushes back on the front cover portion 62. The rearward force on the gutter cover causes the material of the gutter cover to flex resiliently so that the channel formation of the front cover portion 62 can be pushed down to clear the gutter flange 22. When the pushing or squeezing force on the gutter cover 10 is released, the spring tension in the gutter cover urges the front cover portion 62 in a generally forward direction to a position in which the gutter flange 22 is received in the recess defined by the channel formation and the channel formation is urged against the gutter flange. The spring tension also urges the rear cover portion 66 in a generally rearward direction such that the lower end of the rear portion is urged against the rear portion 36 of each gutter hanger 26 at the rear bend 40 of the hanger, as illustrated in FIG. 3. The pressure contact of the front cover portion 62 against the gutter flange 22 and the rear cover portion 66, 66', 66" against the gutter hanger at the bend 40 locks the gutter cover in place without the need for fasteners.

Optionally, the central cover portion 60 can be formed with at least one linear canal 150 extending lengthwise of the gutter cover (see FIGS. 1 and 2). The canal strengthens the cover and helps to more evenly distribute the flow of water across the central cover portion of the gutter cover. Alternatively, the central cover portion can be formed with one or more upstanding ribs for strengthening the cover.

Figure 6:
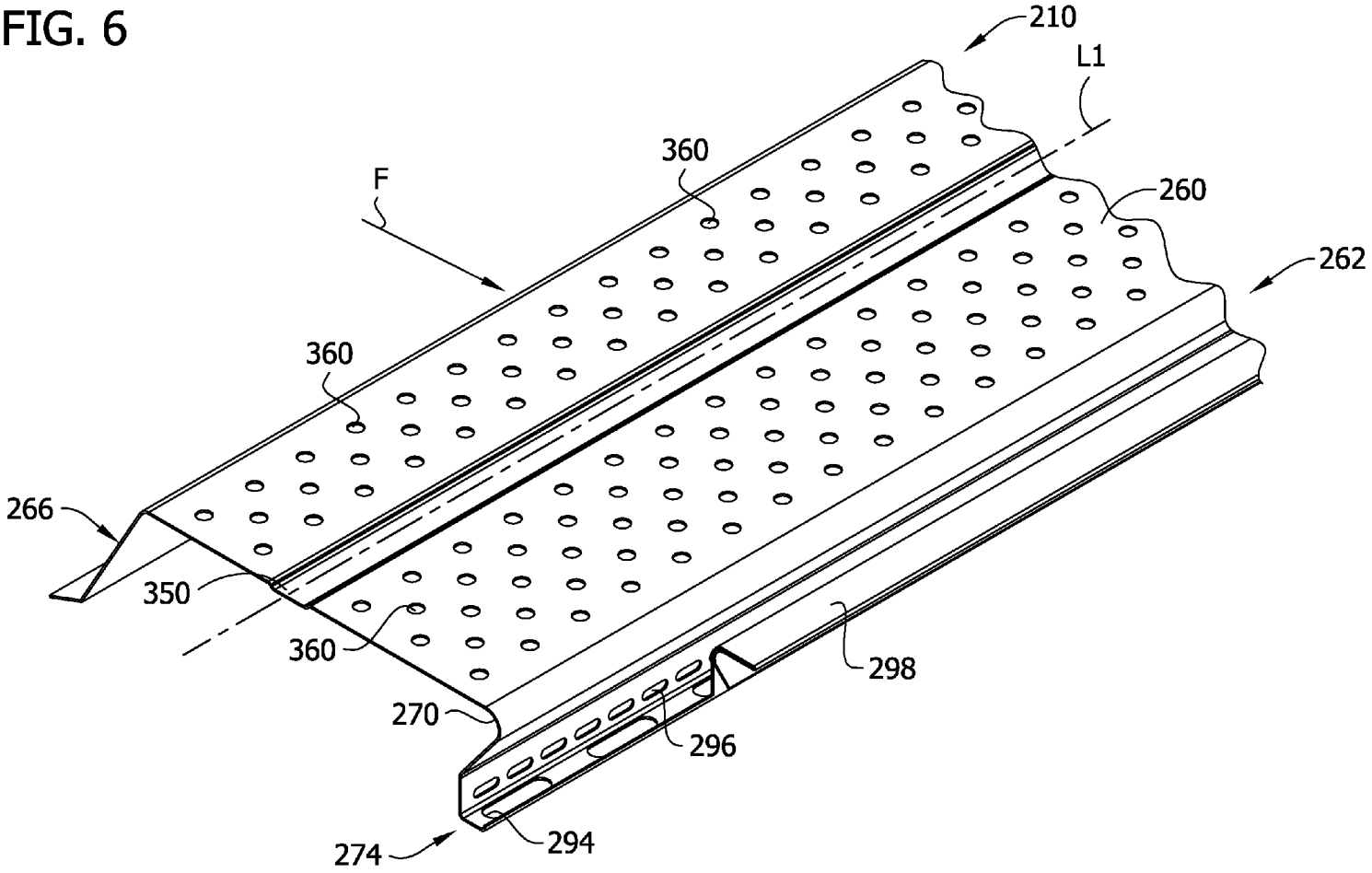
FIG. 6 is a perspective view of another embodiment of a gutter cover of this invention, portions of a drain trough of the gutter cover being broken away to show details.
Figure 7:
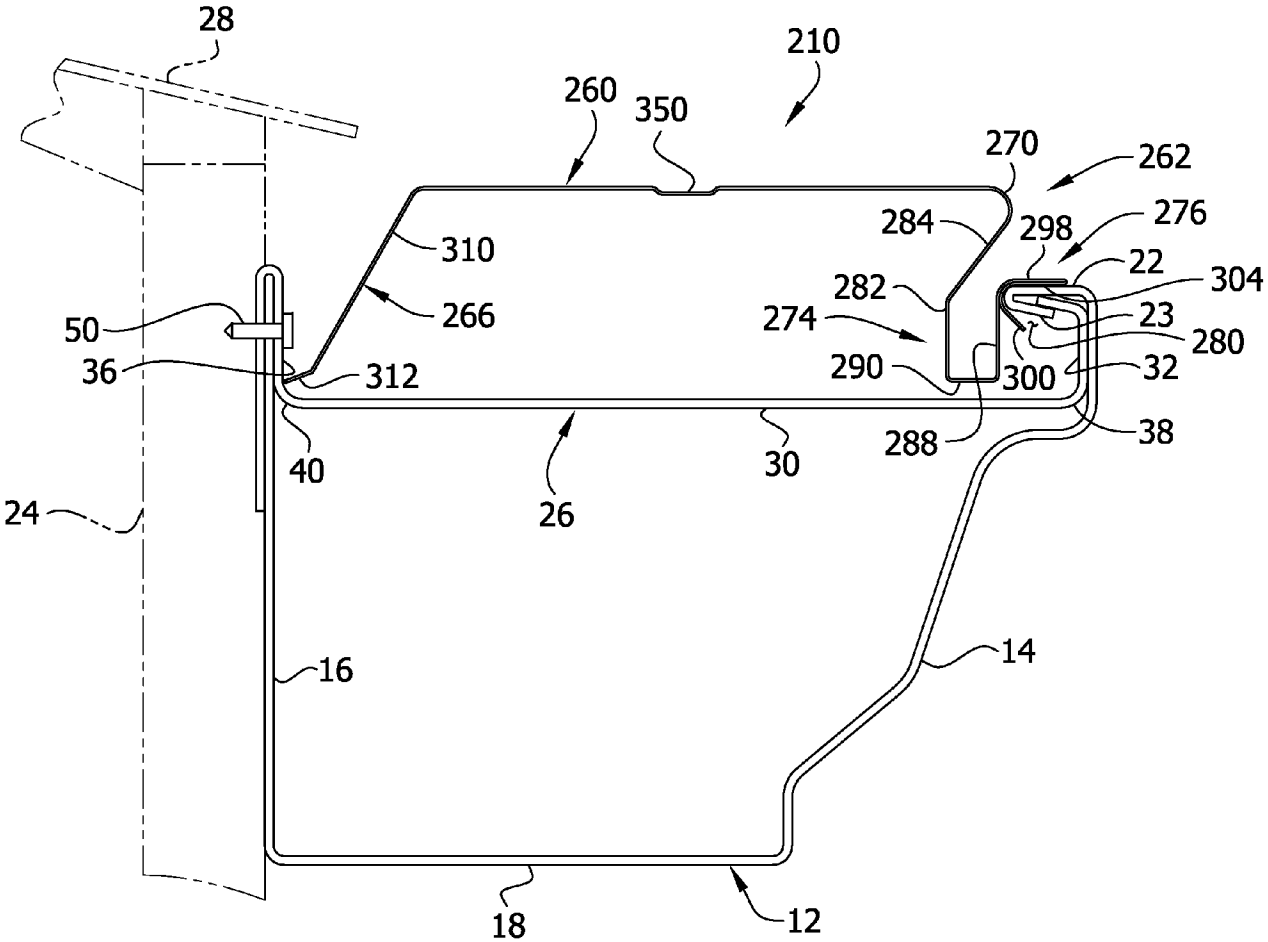
FIG. 7 is a transverse cross-sectional view of the gutter cover of FIG. 6 as installed on a gutter.

FIGS. 6 and 7 illustrate another embodiment of a gutter cover of this invention, generally designated 210. This embodiment is similar to the gutter cover 10 of the first embodiment, and corresponding parts are designated by corresponding reference numbers increased by 200. The gutter cover 210 comprises an elongate sheet of flexible resilient sheet material (e.g., solid sheet with or without perforations, wire mesh sheet, expanded metal sheet) made from metal, such as aluminum, or vinyl, or other plastic having a thickness in the exemplary range of 0.010-0.045 in. The cover 210 has a longitudinal axis L1 transverse to the direction of water flow F down the roof. In its installed position (FIG. 7), the cover 210 has a central cover portion generally designated 260 configured to overlie the gutter, a front cover portion generally designated 262 configured for contact with the gutter flange 22, and a rear cover portion generally designated 266 configured for contact with the rear portion of the gutter hanger at or adjacent the rear bend 40 of the gutter hanger. Desirably, the central, front, and rear cover portions 262, 266 of the gutter cover 210 are integrally formed as a single unitary member (i.e., in one piece).

Referring again to FIGS. 6-7, the central cover portion 260 is substantially flat and lies in a generally horizontal plane when the gutter cover is installed on a gutter. However, other configurations are possible. By way of example but not limitation, the central cover portion may be non-planar, e.g., upwardly arched.

The front cover portion 262 comprises a surface tension curve 270 curving downward and rearward from the central cover portion for directing water in a downward and rearward direction, and a drain trough generally designated 274 extending lengthwise of the gutter cover below the surface tension curve for collecting water directed by the surface tension curve. By way of example but not limitation, the surface tension curve may be a concave curve having only one radius of curvature or a concave curve having more than one radius of curvature, as described in my U.S. Pat. No. 7,765,742 incorporated herein by reference. The front cover portion 262 also includes a channel formation generally designated 276 forward of the drain trough defining a recess 280 extending lengthwise of the gutter cover for receiving the gutter flange 22 when the gutter cover is in its installed position.

In the embodiment of FIGS. 6-7, the drain trough 274 comprises an upright back wall 282 connected by a straight wall segment 284 to the lower end of the surface tension curve 270, an upright front wall 288 spaced forward from the back wall and connected to the channel formation 276, and a bottom wall 290 which, in this embodiment, is generally horizontal. Desirably, the bottom wall 290 is located rearward of the surface tension curve 270, and the surface tension curve is located directly over the channel formation 276. In the illustrated embodiment, the front end of the surface tension curve 270 is positioned slightly forward of the back end of the channel formation 276. Other configurations are possible. The front and back walls 288, 282 of the drain trough 74 lie in generally vertical trough wall planes when the gutter cover is in its installed position.

Referring to FIG. 6, one or more drain openings 294 are provided in the bottom wall 290 of the drain trough 274 for draining water into the gutter. In one embodiment, slots are provided having lengths aligned with the length of the trough and spaced at intervals along the bottom wall of the trough. By way of example but not limitation, the slots may have a width in the range of ¼ in to ⅜ in (e.g., about 5/16 in.), a length in the range of ¾ in to 2 in (e.g., about 1¼ in.), and adjacent slots may be separated by a distance in the range of ¼ in to 2 in (e.g., about ¾ in). In the illustrated embodiment, one or more drain openings 296 are also provided in the back wall 282 of the drain trough 274 for draining water into the gutter. In one embodiment, slots are provided having lengths aligned with the length of the trough and spaced at intervals along the bottom wall of the trough. By way of example but not limitation, the slots 296 may have a width in the range of 1/16 in to ⅜ in (e.g., about ⅛ in.), a length in the range of ¼ in to 2 in (e.g., about 1 in.), and adjacent slots may be separated by a distance in the range of ¼ in to 2 in (e.g., about ¾ in). The drain openings 294, 296 may have other shapes (e.g., circular).

Referring to FIG. 7, the channel formation 276 comprises an upper leg 298 extending forward from the drain trough 274 and adapted to overlie the gutter flange 22, and a lower leg 300 extending forward and downward relative to the upper leg to define the recess 280 for receiving the gutter flange 22 when the gutter cover is in said installed position. The upper leg 298 extends generally horizontally when the gutter cover is in its installed position, and the lower leg 300 extends at an acute angle relative to the upper leg 98 when the gutter cover is in its installed position. By way of example but not limitation, this angle may be in the range of 30-90 degrees (e.g., about 40-50 degrees). The upper and lower legs 298, 300 of the channel formation are integrally connected by a third leg 304 underlying the upper leg. The channel formation may have other configurations.

Desirably, the bottom wall 290 of the drain trough 274 is located at an elevation below the upper leg 298 of the channel formation 276. As a result, when the gutter cover 210 is installed on a gutter, the bottom wall 290 of the trough is at an elevation below the gutter flange 22. This arrangement reduces the risk of water overflowing the gutter flange.

The rear cover portion 266 of the gutter cover 210 comprises a straight leg 310 extending downward and rearward at an oblique angle (e.g., 90-160 degrees, and desirably about 120 degrees) from the substantially flat central cover portion 260. This profile keeps the rear cover portion 266 of the gutter in resilient engagement with the gutter hanger 26 when the gutter cover is installed on the gutter. In the embodiment of FIG. 7, the lower end of the leg is bent at an angle relative to the leg to form a foot 312 which contacts the rear portion 36 of the gutter hanger (at or near the rear bend 40) when the gutter cover is installed on the gutter. The rear cover portion 266 of the gutter cover 210 may have other configurations without departing from the scope of this invention. By way of example, the rear cover portion 266 may be configured as shown in FIGS. 4 and 5 (66', 66"). Other configurations are possible. By way of example but not limitation, the rear cover portion 266 of the gutter cover 210 may have the multiple-bend configurations described in my U.S. Pat. Nos. 7,891,142, 7,650,720, 8,402,697, and D683,827, all of which are incorporated herein by reference.

Desirably, the front cover portion 262, central cover portion 260, and rear cover portion 266 of the gutter cover 210 are integrally formed as one piece of a flexible resilient material. This material resiliently flexes during installation of the gutter cover such that when the gutter cover is installed, the channel formation 276 of the front cover portion 262 is resiliently urged against the gutter flange 22 and the rear cover portion 266 is resiliently urged against the rear portion 36 of the gutter hanger 26, as illustrated in FIGS. 6-7.

Referring to FIG. 6, it will be observed that drain holes 360 are provided in the central cover portion 260. These holes are of suitable size and shape. By way of example but not limitation, the drain holes may be round and have a diameter in the range of 1/16-1/2 in, e.g., about 3/16 in. The holes 360 are distributed substantially uniformly along one or more rows and desirably (but not necessarily) cover substantially the entire area of the central cover portion 260.

Figure 8:
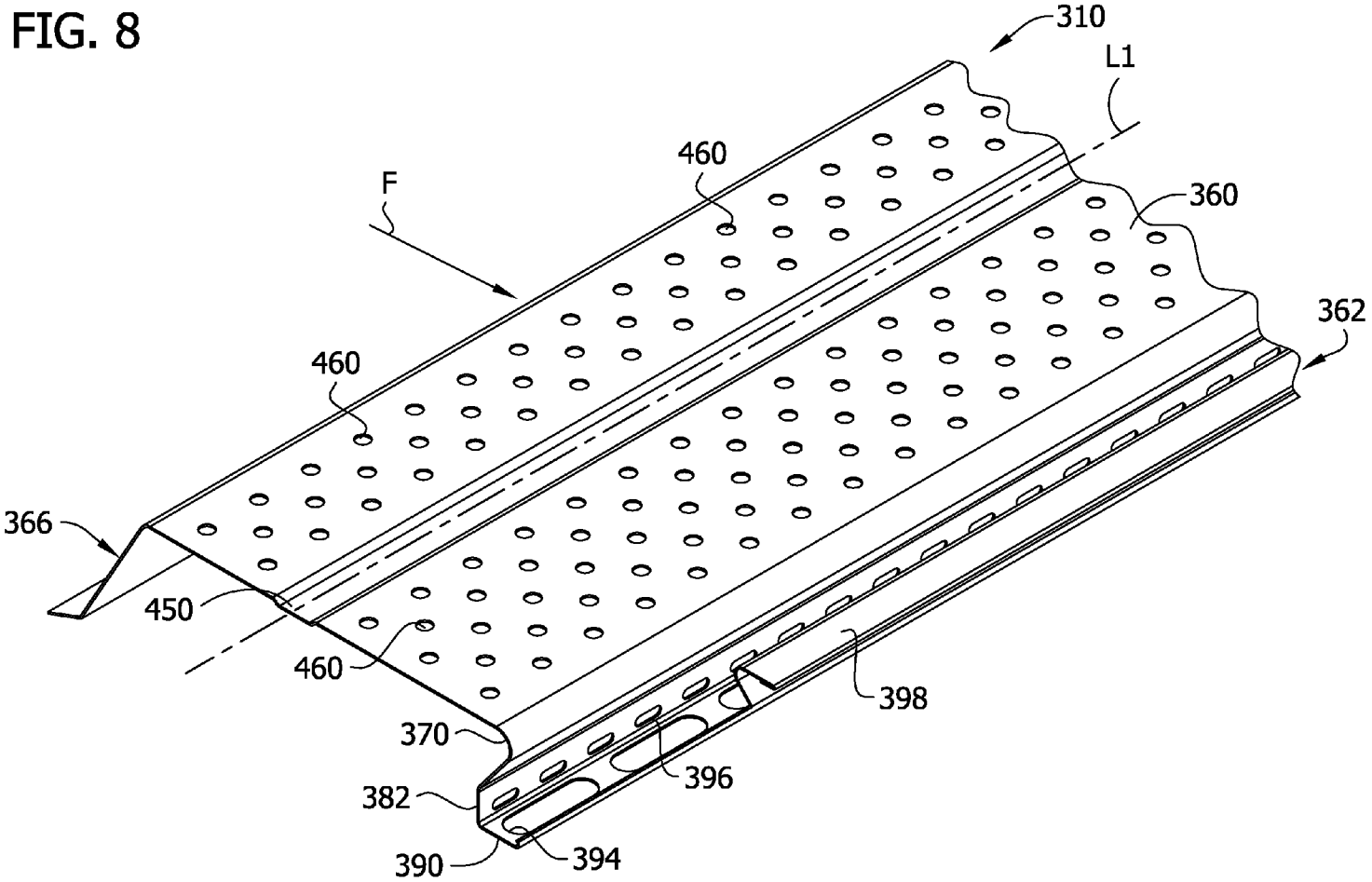
FIG. 8 is a perspective view of another embodiment of a gutter cover of this invention, portions of a drain trough of the gutter cover being broken away to show details.
Figure 9:
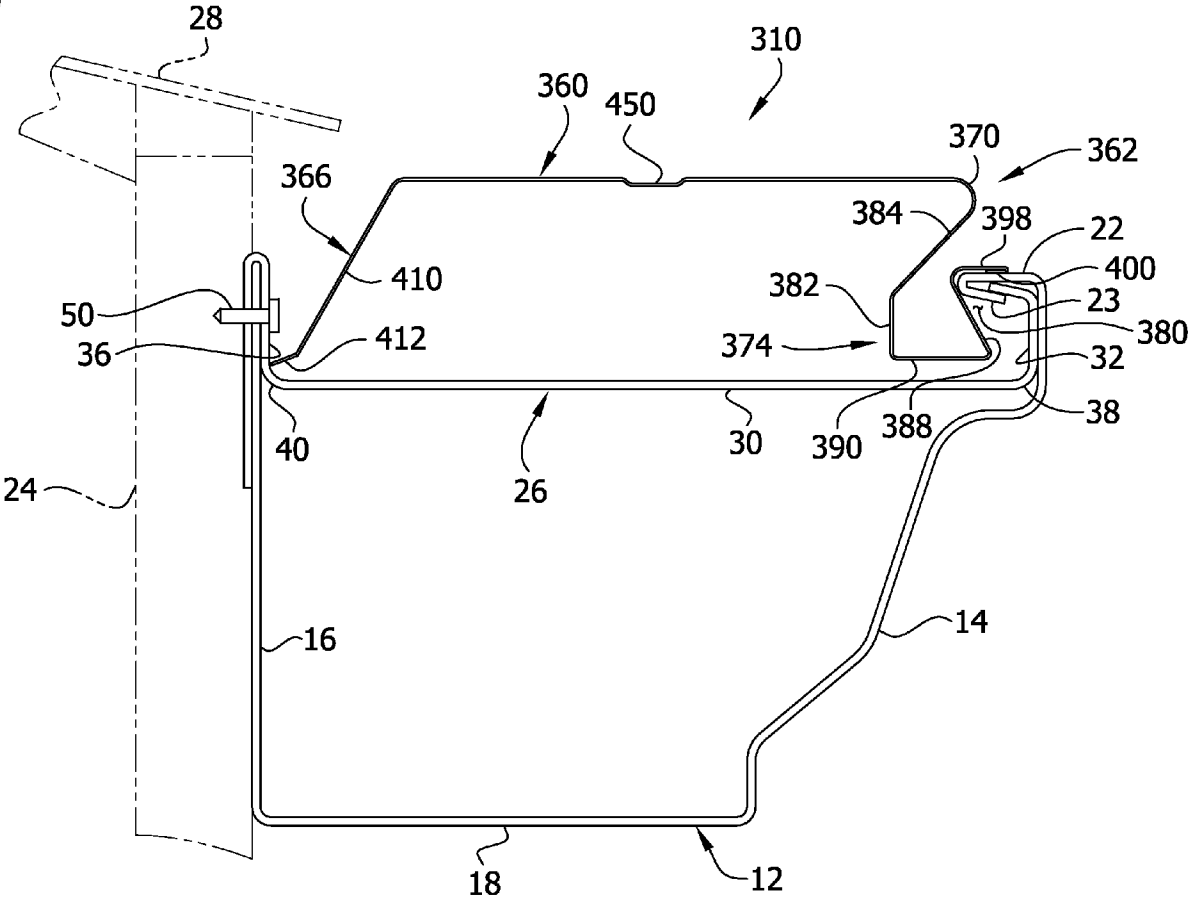
FIG. 9 is a transverse cross-sectional view of the gutter cover of FIG. 8 as installed on a gutter.

FIGS. 8 and 9 illustrate another embodiment of a gutter cover of this invention, generally designated 310. This embodiment is similar to the gutter cover 10 of the first embodiment, and corresponding parts are designated by corresponding reference numbers increased by 300. The gutter cover 310 comprises an elongate sheet of flexible resilient sheet material (e.g., solid sheet with or without perforations, wire mesh sheet, expanded metal sheet) made from metal, such as aluminum, or vinyl, or other plastic having a thickness in the exemplary range of 0.010-0.045 in. The cover 310 has a longitudinal axis L1 transverse to the direction of water flow F down the roof. In its installed position (FIG. 9), the cover 310 has a central cover portion generally designated 360 configured to overlie the gutter, a front cover portion generally designated 362 configured for contact with the gutter flange 22, and a rear cover portion generally designated 366 configured for contact with the rear portion of the gutter hanger at or adjacent the rear bend 40 of the gutter hanger. Desirably, the central, front, and rear cover portions 362, 366 of the gutter cover 310 are integrally formed as a single unitary member (i.e., in one piece).

Referring again to FIGS. 8-9, the central cover portion 360 is substantially flat and lies in a generally horizontal plane when the gutter cover is installed on a gutter. However, other configurations are possible. By way of example but not limitation, the central cover portion may be non-planar, e.g., upwardly arched.

The front cover portion 362 comprises a surface tension curve 370 curving downward and rearward from the central cover portion for directing water in a downward and rearward direction, and a drain trough generally designated 374 extending lengthwise of the gutter cover below the surface tension curve for collecting water directed by the surface tension curve. By way of example but not limitation, the surface tension curve may be a concave curve having only one radius of curvature or a concave curve having more than one radius of curvature, as described in my U.S. Pat. No. 7,765,742 incorporated herein by reference. The front cover portion 362 also includes a leg 398 extending forward from the drain trough 374 to define a recess 380 extending lengthwise of the gutter cover for receiving the gutter flange 22 when the gutter cover is in its installed position.

In the embodiment of FIGS. 8-9, the drain trough 374 comprises an upright back wall 382 connected by a straight wall segment 384 to the lower end of the surface tension curve 370, an upright front wall 388 spaced forward from the back wall, and a bottom wall 390 which, in this embodiment, is generally horizontal. Desirably, the bottom wall 390 is located rearward of the surface tension curve 370, and the surface tension curve is located directly over the leg 398. In the illustrated embodiment, the front end of the surface tension curve 370 is positioned slightly forward of the back end of the leg 398. Other configurations are possible. The back wall 382 of the drain trough 374 lies in generally vertical trough wall plane when the gutter cover is in its installed position. The front wall 388 of the drain trough 374 lies in a trough wall plane sloping upward and rearward from the bottom wall 390 of the drain trough to the leg 398 overlying the gutter flange when the gutter cover is in its installed position. The front trough wall plane slopes at an angle relative to a plane defining the central cover portion 360 of the gutter cover. By way of example but not limitation, this angle may be in the range of 30-90 degrees (e.g. about 45-50 degrees).

Referring to FIG. 8, one or more drain openings 394 are provided in the bottom wall 390 of the drain trough 374 for draining water into the gutter. In one embodiment, slots are provided having lengths aligned with the length of the trough and spaced at intervals along the bottom wall of the trough. By way of example but not limitation, the slots 394 may have a width in the range of 1/4 in to 3/8 in (e.g., about 5/16 in.), a length in the range of 3/4 in to 2 in (e.g., about 1 1/4 in.), and adjacent slots may be separated by a distance in the range of 1/4 in to 2 in (e.g., about 3/4 in). In the illustrated embodiment, one or more drain openings 396 are also provided in the back wall 382 of the drain trough 374 for draining water into the gutter. In one embodiment, slots are provided having lengths aligned with the length of the trough and spaced at intervals along the bottom wall of the trough. By way of example but not limitation, the slots 396 may have a width in the range of 1/16 in to 3/8 in (e.g., about 1/8 in.), a length in the range of 1/4 in to 2 in (e.g., about 1 in.), and adjacent slots may be separated by a distance in the range of 1/4 in to 2 in (e.g., about 3/4 in). The drain openings 394, 396 may have other shapes (e.g., circular).

Referring to FIG. 9, it will be observed that the recess 380 is defined by the leg 398 and the front wall 388 of the drain trough 374. Other recess-defining configurations are possible. In the illustrated embodiment, the forward end portion of the leg 398 is bent to form a hem 400 to provide additional rigidity to the front cover portion.

Desirably, the bottom wall 390 of the drain trough 374 is located at an elevation below the leg 398. As a result, when the gutter cover 310 is installed on a gutter, the bottom wall 390 of the trough is at an elevation below the gutter flange 22. This arrangement reduces the risk of water overflowing the gutter flange.

The rear cover portion 366 of the gutter cover 310 comprises a straight leg 410 extending downward and rearward at an oblique angle (e.g., 90-160 degrees, and desirably about 120 degrees) from the substantially flat central cover portion 360. This profile keeps the rear cover portion 366 of the gutter in resilient engagement with the gutter hanger 26 when the gutter cover is installed on the gutter. In the embodiment of FIG. 9, the lower end of the leg is bent at an angle relative to the leg to form a foot 412 which contacts the rear portion 36 of the gutter hanger (at or near the rear bend 40) when the gutter cover is installed on the gutter. The rear cover portion 366 of the gutter cover 310 may have other configurations without departing from the scope of this invention. By way of example, the rear cover portion 366 may be configured as shown in FIGS. 4 and 5 (66', 66"). Other configurations are possible. By way of example but not limitation, the rear cover portion 366 of the gutter cover 310 may have the multiple-bend configurations described in my U.S. Pat. Nos. 7,891,142, 7,650,720, 8,402,697, and D683,827, all of which are incorporated herein by reference.

Desirably, the front cover portion 362, central cover portion 360, and rear cover portion 366 of the gutter cover 310 are integrally formed as one piece of a flexible resilient material. This material resiliently flexes during installation of the gutter cover such that when the gutter cover is installed, the front cover portion 362 is resiliently urged against the gutter flange 22 and the rear cover portion 366 is resiliently urged against the rear portion 36 of the gutter hanger 26, as illustrated in FIGS. 8-9.

Referring to FIG. 8, it will be observed that drain holes 460 are provided in the central cover portion 360. These holes are of suitable size and shape. By way of example but not limitation, the drain holes may be round and have a diameter in the range of 1/16-1/2 in, e.g., about 3/16 in. The holes 460 are distributed substantially uniformly over one or more rows of and desirably (but not necessarily) cover substantially the entire area of the central cover portion 360.

The gutter cover designs described above has many advantages. Using a front surface tension curve, the cover efficiently and effectively directs the flow of water in the desired direction toward the gutter. The gutter cover can be installed without the use of fasteners, thus facilitating the installation process. Further, the cover may be installed without the need to slide the cover under the shingles on a roof or otherwise disturbing the roof shingles. As a result, no shingles are disturbed, keeping the shingle warranty in place. Moreover, when the gutter needs maintenance, the cover can be easily removed and later readily reinstalled. There is no other gutter cover on the market that incorporates all of these advantages.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. Further, all dimensional information set forth herein is exemplary only and is not intended to limit the scope of the invention. It is understood that any of the particular embodiments of the present invention may include one or more of the aspects or features of the invention as described herein and illustrated in the drawings.

What is claimed is:

1. An elongate gutter cover of resilient flexible material for covering a gutter supported by a gutter hanger, the gutter having a front wall, a back wall, a bottom wall, and a gutter flange projecting rearward from the front wall and spaced above the bottom wall of the gutter, the gutter cover comprising a central cover portion adapted to overlie the gutter when the gutter cover is in an installed position on the gutter, a front cover portion comprising a surface tension curve curving downward and rearward from the central cover portion for directing water in a downward and rearward direction, a drain trough extending lengthwise of the gutter cover below the surface tension curve for collecting water directed by the surface tension curve, and one or more drain openings in the drain trough for draining water into the gutter, and a recess forward of the drain trough extending lengthwise of the gutter cover for receiving the gutter flange when the gutter cover is in said installed position, and a rear cover portion extending down from the central cover portion and terminating in a lower end adapted for contact with the gutter hanger when the gutter cover is in said installed position, wherein the central cover portion, front cover portion, and rear cover portion of the gutter cover are made of resiliently flexible solid sheet material, with or without perforations, and wherein said recess for receiving the gutter flange is defined by a channel formation comprising an upper leg extending forward from the drain trough and adapted to overlie the gutter flange when the gutter cover is in said installed position, a lower leg below the upper leg and adapted to underlie the gutter flange when the gutter cover is in said installed position, and a third leg between the upper and lower legs integrally connecting the upper and lower legs, the third leg originating from a forward end of the upper leg and extending rearward from the forward end of the upper leg to a rearward end of the lower leg, and the lower leg originating from a rearward end of the third leg and extending forward from the rearward end of the third leg to a location spaced below the third leg such that said recess is formed between the third leg and the lower leg.

2. The gutter cover of claim 1, wherein the drain trough has a bottom wall located rearward of the surface tension curve, and wherein the surface tension curve is located directly over said recess.

3. The gutter cover of claim 1, wherein the drain trough comprises front and back walls lying in substantially parallel and substantially vertical trough wall planes.

4. The gutter cover of claim 1, wherein the drain trough comprises a substantially vertical back wall extending up from the bottom wall.

5. The gutter cover of claim 1, wherein the drain trough comprises a back wall connected to the surface tension curve, a front wall spaced forward from the back wall, and a bottom wall, and wherein the back wall of the drain trough lies in a substantially vertical trough wall plane.

6. The gutter cover of claim 5, wherein the front and back walls of the drain trough lie in substantially parallel and substantially vertical trough wall planes.

7. The gutter cover of claim 1, wherein the one or more drain openings are in bottom and back walls of the drain trough.

8. The gutter cover of claim 1, wherein the central portion of the gutter cover is generally horizontal, and wherein the rear cover portion of the gutter cover angles down from a bend line defining a rear edge of the central portion of the gutter cover.

9. An elongate gutter cover for covering a gutter supported by a gutter hanger, the gutter having a front wall, a back wall, a bottom wall, and a gutter flange projecting rearward from the front wall and spaced above the bottom wall of the gutter, the gutter cover comprising a central cover portion adapted to overlie the gutter when the gutter cover is in an installed position on the gutter, a front cover portion comprising a surface tension curve curving downward and rearward from the central cover portion for directing water in a downward and rearward direction, a drain trough extending lengthwise of the gutter cover below the surface tension curve for collecting water directed by the surface tension curve, one or more drain openings in the drain trough for draining water into the gutter, and a recess forward of the drain trough extending lengthwise of the gutter cover for receiving the gutter flange when the gutter cover is in said installed position, the recess being defined by a front wall of the drain trough and a leg extending forward from the front wall and overlying the gutter flange when the gutter cover is in said installed position, the front wall of the drain trough sloping upward and rearward from a bottom wall of the drain trough to the leg and underlying the gutter flange when the gutter cover is in said installed position such that the front wall is adapted to engage the gutter flange and inhibit uplift of the gutter guard from its installed position, and a rear cover portion extending down from the central cover portion and terminating in a lower end adapted for contact with the gutter hanger when the gutter cover is in said installed position.

10. The gutter cover of claim 9, wherein the gutter cover is made of a resilient flexible material, the gutter cover resiliently flexing during installation of the gutter cover such that the front cover portion is resiliently urged against the gutter flange and the rear cover portion is resiliently urged against the gutter hanger.

11. The gutter cover of claim 9, wherein the central cover portion of the gutter cover is generally horizontal, and wherein the rear cover portion of the gutter cover extends down from a bend line defining a rear edge of the central cover portion.

12. An elongate gutter cover of resilient flexible material for covering a gutter supported by a gutter hanger, the gutter having a front wall, a back wall, a bottom wall, and a gutter flange projecting rearward from the front wall and spaced above the bottom wall of the gutter, the gutter cover comprising a generally horizontal central cover portion adapted to overlie the gutter when the gutter cover is in an installed position on the gutter, a front cover portion comprising a surface tension curve curving downward and rearward from the central cover portion for directing water in a downward and rearward direction, a drain trough extending lengthwise of the gutter cover below the surface tension curve for collecting water directed by the surface tension curve, one or more drain openings in the drain trough for draining water into the gutter, and a recess forward of the drain trough extending lengthwise of the gutter cover for receiving the gutter flange when the gutter cover is in said installed position, the recess being defined by a front wall of the drain trough and a leg extending forward from the front wall and overlying the gutter flange when the gutter cover is in said installed position, the front wall of the drain trough sloping upward and rearward from a bottom wall of the drain trough to the leg and underlying the gutter flange when the gutter cover is in said installed position such that the front wall is adapted to engage the gutter flange and inhibit uplift of the gutter guard from its installed position, and a rear cover portion extending down from a bend line defining a rear edge of the central cover portion, the rear cover portion terminating in a lower end adapted for contact with the gutter hanger when the gutter cover is in said installed position, and wherein the central cover portion, front cover portion, and rear cover portion of the gutter cover are made of resiliently flexible solid sheet material, with or without perforations.

13. The gutter cover of claim 1, wherein the lower end of the rear cover portion is located below the central cover portion.

14. The gutter cover of claim 6, wherein the front and back walls of the drain trough are substantially vertical walls having approximately the same vertical height.

15. The gutter cover of claim 1, wherein the upper leg and third leg extend substantially horizontally, and wherein the lower leg slopes forward and downward at an angle of 30-90 degrees.

16. The gutter cover of claim 12, wherein the back wall of the drain trough is substantially vertical.

* * * * *